United States Patent [19]

Alexion et al.

[11] Patent Number: 4,963,694

[45] Date of Patent: Oct. 16, 1990

[54] CONNECTOR ASSEMBLY FOR INTERNALLY-COOLED LITZ-WIRE CABLE

[75] Inventors: Christopher C. Alexion, North Huntingdon; Thomas D. Hordubay, Penn Hills Township, Allegheny County; Wesley Mamrose, North Huntingdon, all of Pa.; Steven R. Walk, Winterport, Me.; Robert M. Slepian, Wilkinsburg, Pa.

[73] Assignee: Westinghouse Electric Corp., Pittsburgh, Pa.

[21] Appl. No.: 361,205

[22] Filed: Jun. 5, 1989

[51] Int. Cl.[5] ..... H01B 7/34

[52] U.S. Cl. ..... 174/15.6; 174/15.7; 174/19; 439/196; 439/485

[58] Field of Search ..... 174/15.6, 15.7, 19; 496/196, 485

[56] References Cited

U.S. PATENT DOCUMENTS

| | | | |
|---|---|---|---|
| 2,111,027 | 3/1938 | Martin | 174/47 |
| 3,946,349 | 3/1976 | Haldeman III | 336/62 |
| 4,142,770 | 3/1979 | Butler, Jr. et al. | 439/196 X |
| 4,152,538 | 5/1979 | Gassinger et al. | 174/19 |
| 4,258,939 | 3/1981 | Karlen | 174/15.6 X |
| 4,382,239 | 5/1983 | Chen et al. | 333/248 |
| 4,596,433 | 6/1986 | Osterheld et al. | 439/206 |

FOREIGN PATENT DOCUMENTS

| | | | |
|---|---|---|---|
| 76819 | 12/1953 | Denmark | 174/19 |
| 72 6054 | 5/1932 | France | 174/19 |
| 982131 | 12/1982 | U.S.S.R. | 174/15.7 |

*Primary Examiner*—Morris H. Nimmo

[57] ABSTRACT

A connector assembly for transferring high-frequency current into or from a Litz-wire electrical cable having multiple conductor strands includes a transition connector component, a terminal connector component, and a coupling collar. The transition component has an annular groove which receives the splayed ends of the multiple conductor strands and makes electrical connection therewith by soldering of the conductor strand ends to the transition component at the groove. The transition component also has a central opening through it for providing flow communication with the internal coolant flow channel of the electrical cable. The terminal connector component has an orifice through it for establishing flow communication between the transition component opening and an external source of coolant. The terminal component also has a tab projecting from it for making an external electrical connection. The transition and terminal components are electrically connected together by fasteners. The collar has a housing of frusto-conical configuration for fitting over end portions of the conductor strands of the cable which have the ends in the annular splayed configuration. An end portion of the housing can be clamped to the Litz-wire cable. The collar housing and transition component have complementary threaded portions for attaching them together.

16 Claims, 5 Drawing Sheets

CONNECTOR ASSEMBLY FOR INTERNALLY-COOLED LITZ-WIRE CABLE

CROSS REFERENCE TO RELATED APPLICATION

Reference is hereby made to the following copending application dealing with related subject matter and assigned to the assignee of the present invention: "Liquid Metal Electromagnetic Flow Control Device Incorporating A Pumping Action" by R. M. Del Vecchio et al, U.S. Pat. No. 4,842,170, issued June 27, 1989.

BACKGROUND OF THE INVENTION

1. Field of the Invention

The present invention relates generally to high-power density Litz cables and, more particularly, is concerned with a connector assembly for transferring high-frequency current into an internally-cooled Litz-wire cable.

2. Description of the Prior Art

Under high-frequency excitation, an electrical conductor's current density ceases to be uniform. The well-known "skin effect" causes current to move away from the center of the conductor and crowd into a layer just beneath the surface. The effect is compounded in a coil of many turns, wherein the self-fields of each conductor turn induce current density changes in adjacent turns. In order to lessen the impact of the skin effect, standard power cables employ multiple strands of conductors whose cross section is significantly less than that of one larger conductor of the same total area. However, with increasing frequency the impedance (resistance and inductance) of the stranded cable increases because of current crowding caused by unequal magnetic flux linkages among the individual wires.

In contrast, a cable may be formed by transposing individual wires within small groups of wires and then transposing the groups within the conductor. The immediate effect of this cabling method is to equalize the flux linkages of each individual strand, thus causing the current to divide evenly among the strands. If the conductor is constructed loosely, ohmic heating is more evenly distributed in the conductor volume, allowing more efficient heat removal as compared to sheet, ribbon, solid, or hollow conductors. This concept of using individually transposed and insulated strands in a cable-like conductor dates back to the early days of radio engineering practice.

Transposed stranded wire conductors are commercially available under the name Litzendrant conductor or Litz wire. Typically, there are 5 to 19 strands within a group. Groups are then bunched together, typically 5 to 7 in a bunch. Then, bunches are ganged together, typically 4 to 7 in a cable. If more wires are needed for large, high-power cables, several cables are assembled and wrapped by exterior insulation. Each of these operations involves a helical twisting of the elements within the group. The "lay" of the wire can be tight or loose, depending on the pitch of the helical transposition. This has a major effect on the conductor's resistance to internal fluid flow.

For high-power density applications, such as the electromagnetic valve or flow control device disclosed in the above cross-referenced application, internal forced-air cooling of the conductor is required. Environmental factors in the valve design make the use of water cooling hazardous; therefore, air or liquid freon must be used Running at temperatures of 300 degrees C., the cooling requirements are so severe that high-pressure air (12 to 15 atm.) is required with flow rates of up to 5 cfm. This cooling air must be passed to and from the cable through a connector to ensure uniform air flow within the cable. If freon is used, the pressures range from 15 to 22 atm. (to keep the freon liquid) and temperatures of approximately 200 degrees F are reached at the cable outlet.

Thus, the overall requirements of passing high current through many (2,000 or more) wires at high frequency (10 kHz) with internal cooling presents a unique problem to the connector design. Consequently, there is a pressing need for a solution to this connector design problem.

SUMMARY OF THE INVENTION

The present invention provides a connector assembly for a Litz-wire cable which solves the aforementioned design problem. The connector assembly of the present invention provides an effective way of transferring current into or from a Litz-wire cable or between such cables with internal air cooling. The connector assembly allows high-power density Litz cables to be used in commercial applications where space is limited, such as the electromagnetic flow control device of the above cross-referenced application. Electrical impedance measurements indicate little skin effect occurring at typical operating frequencies for the electromagnetic flow control device, namely at 10 kHz.

Accordingly, the present invention is directed to a connector assembly for transferring high-frequency current into or from an electrical cable having multiple conductor strands and an internal coolant flow channel through the cable The connector assembly comprises: (a) a connector body; (b) means on the body for receiving and making electrical connection with ends of the multiple conductor strands disposed in an annular splayed or fanned configuration of a diameter larger than the diameter of the cable; (c) means defining a passage through the connector body for providing flow communication between an external source of coolant and the internal coolant flow channel of the electrical cable; and (d) means on the connector body for making an external electrical connection.

More particularly, the connector body is composed of a transition connector component and a terminal connector component. The receiving means is an annular groove formed in one end of the transition component for receiving the conductor strand ends in the annular splayed configuration and a bonding material for electrically connecting the ends to the transition component at the groove. The annular groove is defined by an outer cylindrical surface and an inner frusto-conical tapered surface extending into the transition component from the one end thereof. The tapered surface intersects with the cylindrical surface. The external electrical connection making means is a tab attached to and projecting from the terminal component of the connector body. The transition and terminal connector components have complementary flat end surfaces and alignable holes formed therein for receiving fasteners to electrically connect the components of the connector body together.

The connector assembly further comprises a coupling collar for fitting over end portions of the conductor strands of the cable which have the ends in the annular splayed configuration. The collar has a main housing of frusto-conical configuration and an end portion with means for attaching to the cable. Also, complementary threaded portions are provided on the collar and terminal connector component for attaching them together.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

In the following description, like references characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Figure 1:
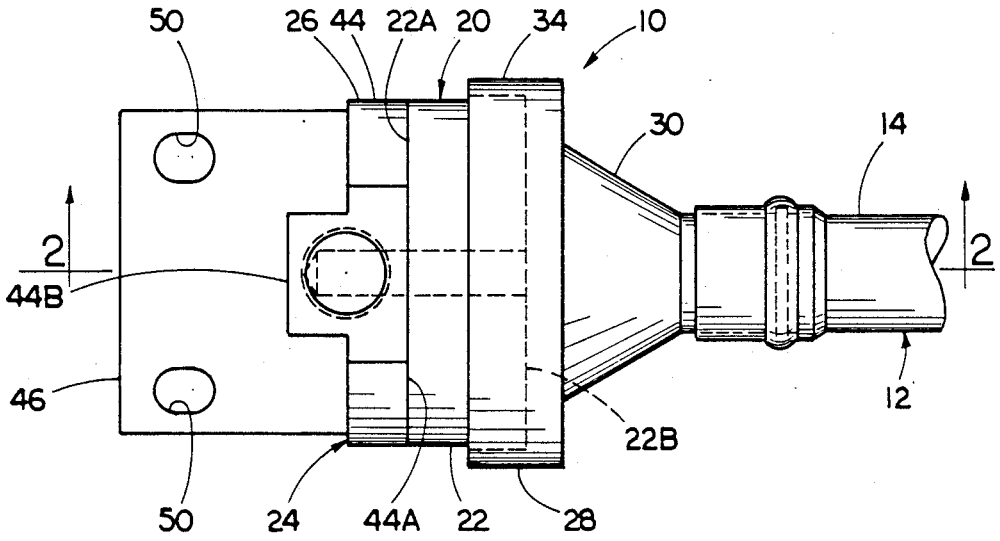
FIG. 1 is a top plan view of a connector assembly coupled to a Litz-wire cable in accordance with the principles of the present invention.
Figure 2:
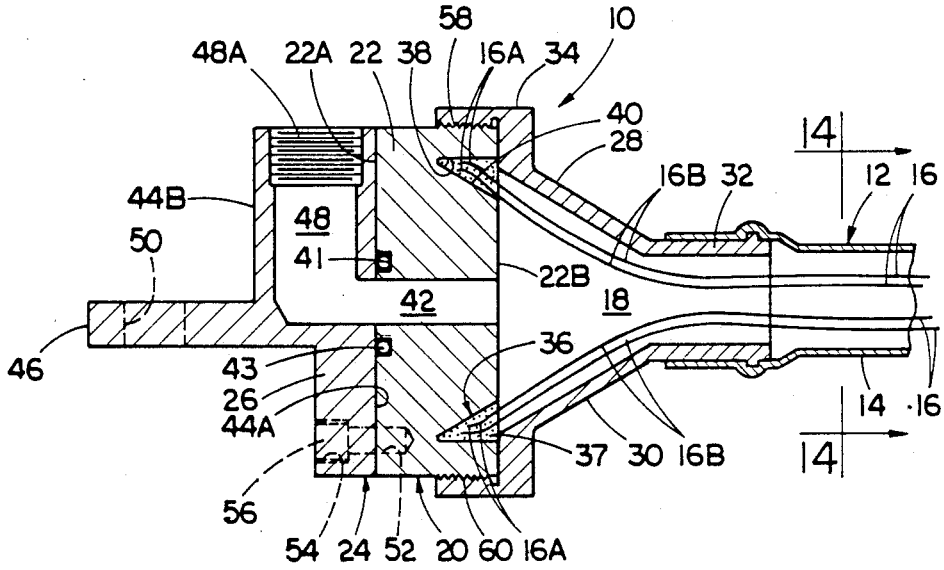
FIG. 2 is a longitudinal axial sectional view of the connector assembly as taken along line 2—2 of FIG. 1.
Figure 3:
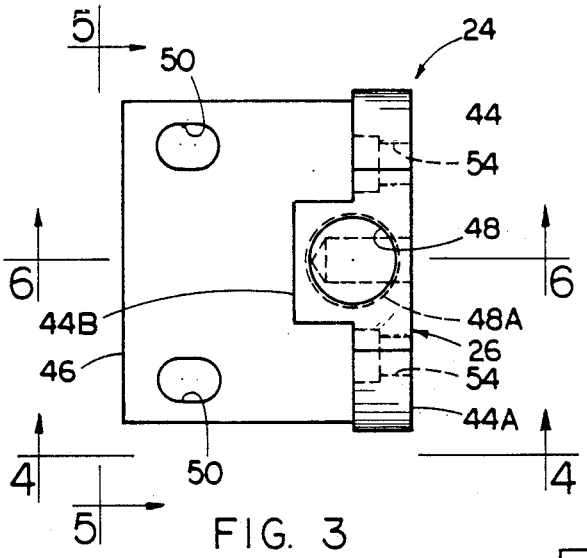
FIG. 3 is a top plan view of a terminal connector component of the connector assembly of FIG. 1.
Figure 4:
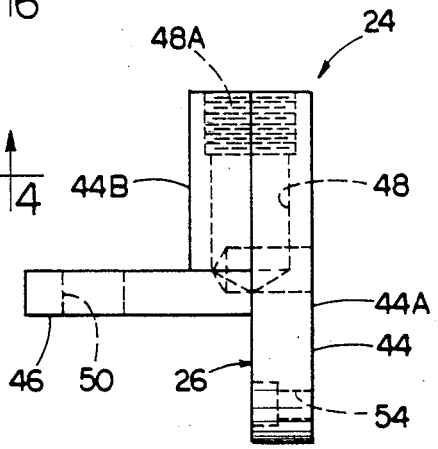
FIG. 4 is a side elevational view of the terminal component as seen along line 4—4 of FIG. 3.
Figure 5:
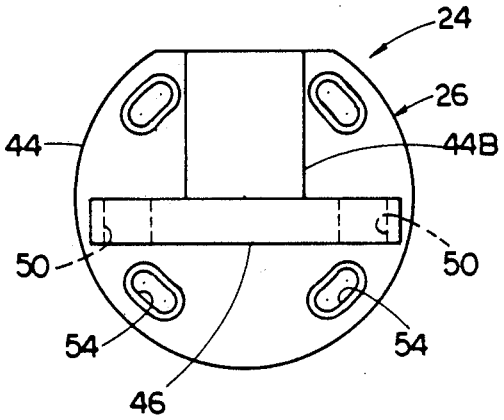
FIG. 5 is a front end elevational view of the terminal component as seen along line 5—5 of FIG. 3.
Figure 6:
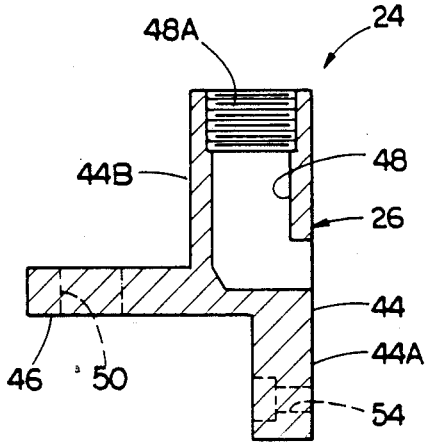
FIG. 6 is an axial sectional view of the terminal component as taken along line 6—6 of FIG. 3.
Figure 8:
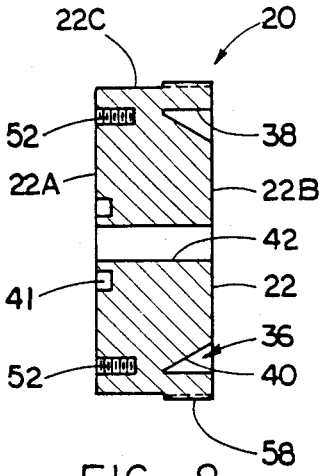
FIG. 8 is an axial sectional view of the transition component as taken along line 8—8 of FIG. 7.
Figure 7:
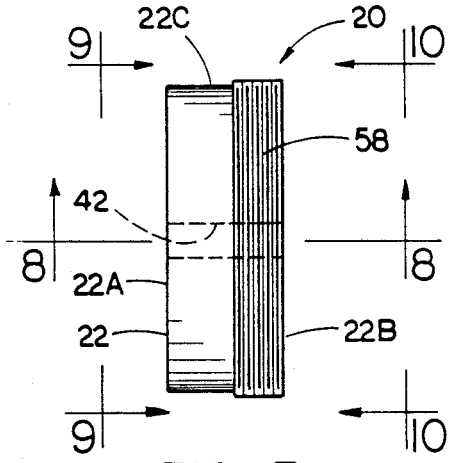
FIG. 7 is a top plan view of a transition connector component of the connector assembly of FIG. 1.
Figure 9:
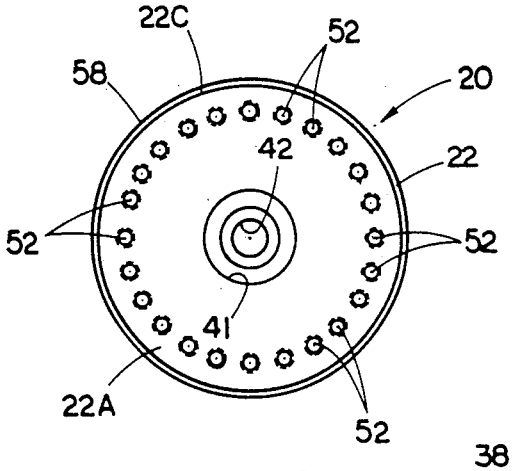
FIG. 9 is a front end elevational view of the transition component as seen along line 9—9 of FIG. 7.
Figure 10:
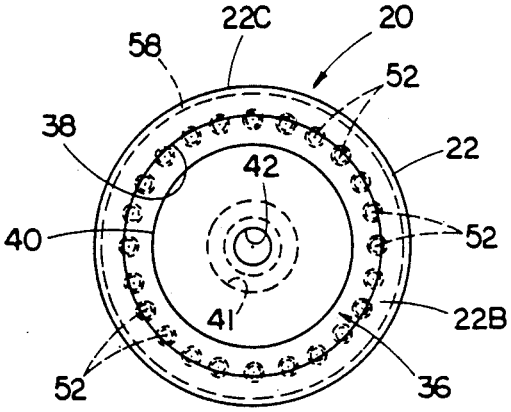
FIG. 10 is a rear end elevational view of the transition component as seen along line 10—10 of FIG. 7.
Figure 12:
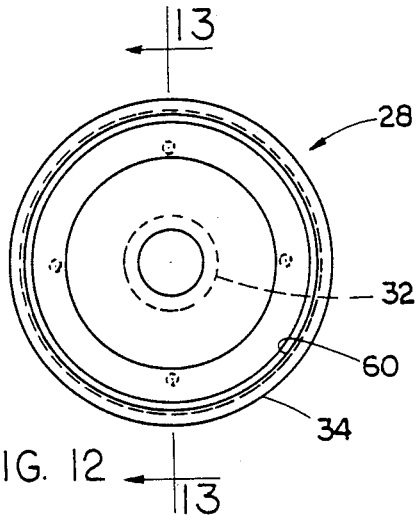
FIG. 12 is a front elevational view of the coupling collar as seen along line 12—12 of FIG. 11.
Figure 11:
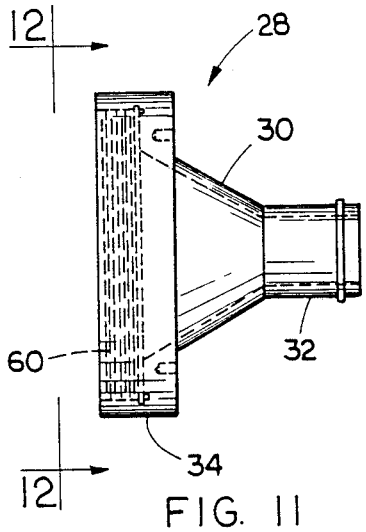
FIG. 11 is a top plan view of a coupling collar of the connector assembly of FIG. 1.
Figure 13:
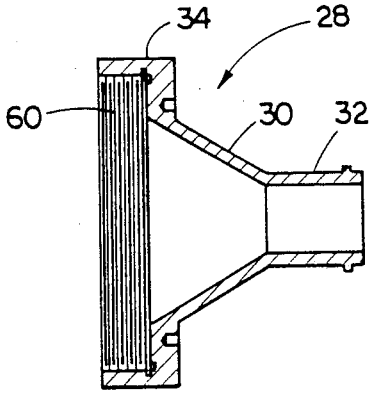
FIG. 13 is an axial sectional view of the coupling collar as taken along line 13—13 of FIG. 11.
Figure 14:
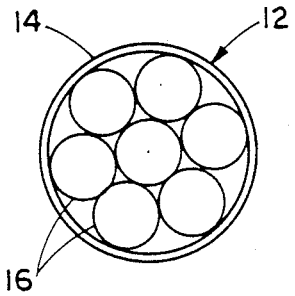
FIG. 14 is an enlarged schematical cross-sectional view taken along line 14—14 of FIG. 2 illustrating one form of Litz-wire cable.
Figure 15:
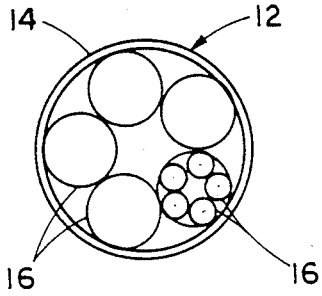
FIG. 15 is a schematical cross-sectional view of another form of Litz-wire cable.

Referring now to the drawings, and particularly to FIGS. 1 and 2, there is shown a connector assembly, generally designated by the numeral 10, constructed in accordance with the principles of the present invention. The connector assembly 10 is primarily designed for transferring high-frequency current into or from a Litz-wire electrical cable 12 with little noticeable skin effect occurring at typical operating frequencies of, for example, 10 kHz. The Litz-wire electrical cable 12 has an outer jacket 14 surrounding and housing multiple conductor strands 16 and an internal coolant flow channel 18 through the cable 12. FIGS. 14 and 15 illustrate schematically two conventional types of Litz-wire cable 12 With respective twisted strands 16.

To use the connector assembly 10 with the Litz-wire cable 12 in the manner illustrated in FIG. 2, the conductor wires or strands 16 are first separated from their groups and fanned or splayed out to the condition seen in FIG. 2. In such splayed condition, the ends 16A of the strands 16 define an annular configuration (or annulus) having a diameter greater than the diameter of the cable 12. The insulation is stripped from the copper wires or strands 16 by dipping in hot (400 degrees C.) alkali solution and scouring with a hard wire brush. The ends 16A of the wires are then formed into the annular configuration having a mean thickness roughly equal to one skin depth in brass. The splayed wire ends 16A are then soldered together to place them in condition for connection to the connector assembly 10, as will be described below The reasons for fanning or splaying out of the cable conductor ends 16A is to transfer current equally into each wire of the cable at less resistance and to make it easier to inject coolant into the cable. If the conductors of the cable were merely crimped onto the connector, the resistance would be five to six times higher with the current merely staying on the outside skin or surface of the twisted conductors of the cable 12.

In its basic parts, the connector assembly 10 includes a transition connector component 20 having a generally cylindrical-shaped body 22, a terminal connector component 24 having a generally T-shaped body 26 and a coupling collar 28 having a main housing 30 of frusto-conical shape with opposite end portions 32, 34 of generally cylindrical shape. Preferably, the transition and terminal components 20, 24 are composed of brass and the collar 28 is composed of aluminum. The transition component 20 is for joining to the conductor strands 16 of the cable 12, whereas the terminal component 24 is for joining to a flat bussbar or to a terminal component of another connector assembly placed in mirror image to it.

Referring to FIGS. 1, 2 and 7–10, the cylindrical body 22 of the transition component 20 has axially-spaced front and rear flat circular surfaces 22A, 22B and an outer circumferential cylindrical surface 22C extending between and interconnecting the front and rear surfaces 22A, 22B. The transition component 20 has an annular frustum-shaped recess or groove 36 formed, such as by machining, in its rear surface 22B which receives and mates with the annular configuration of splayed ends 16A of the multiple conductor strands 16 and makes electrical connection therewith by use of a suitable bonding material 37, such as by soldering the conductor strand ends 16A to the transition component 20 at the groove 36. The annular groove 36 is defined by an outer cylindrical surface 38 and an inner frustoconical tapered surface 40 both of which extend into the transition component body 22 from the rear surface 22B thereof. Tapered surface 40 intersects with the cylindrical surface 38. The body 22 of the transition component 20 also has a central opening 42 extending through it for providing flow communication with the internal coolant flow channel 18 of the Litz-wire electrical cable 12. An annular recess 41 is formed in the front surface 22A of the body 22 surrounding the opening 42 for seating an O-ring 43 therein to provide a coolant seal between the bodies 22, 26.

Referring to FIGS. 1–6, the T-shaped body 26 of the terminal connector component 24' has a generally flat base 44 with a flat surface 44A at its rear end and a flat extension 46 integrally formed with and extending axially from the front end of the base 44 in generally orthogonal relation thereto. The base 44 also has a midsection 44B of a thickness greater than the remainder of the base. An orifice 48 is formed through the base 44 at its thicker midsection 44B for establishing flow communication between an external source of coolant (not shown) and the central opening 42 of the transition component 20. The orifice 48 extends axially in orthogonal relation to the axis of the central opening 42 through the transition component body 22. The orifice 48 also has an internally threaded end portion 48A for threadably receiving a fitting (not shown) of the external source of coolant. The flat extension 46 of the terminal component 24 defines a tab projecting forwardly from the base 44 for making an external electrical connection, such as with an identical tab on another connector assembly. A pair of slots 50 are provided through the tab 46 for use in fastening and electrically connecting it to the terminal of another connector.

The bodies 22, 26 of the transition and terminal components 20, 22 are fastened together for providing electrical connection therebetween by complementary means provided thereon. The complementary means include the front flat end surface 22A of the transition component body 22, the rear surface 44A of the terminal component base 44, and sets of alignable holes 52 and arcuate slots 54 formed therein for receiving fasteners in the form of screws 56 (only one being seen in FIG. 2) to electrically connect the components 20, 24 together. The holes 52 in front flat end surface 22A of the transition component 20 are greater in number (for example, twenty-four) than the slots 54 through the terminal component base 44. There are four slots 54 elongated eighteen degrees and displaced forty-five degrees end-to-end. The arcuate shape of the slots 54 allow rotation of the terminal component 24 relative to the transition component 20 to facilitate aligning the fastening screws 56 with the proper ones of the holes 52.

Referring to FIGS. 1, 2 and 11–13, the frusto-conical configuration of the main housing 30 of the coupling collar 28 adapts the collar 28 for fitting over end portions 16B of the conductor strands 16 of the cable 12 which have the ends 16A in the annular splayed configuration electrically connected to the transition connector component 20. The collar 28 at its rear or right end portion 32 of the housing 30 is slipped within the outer jacket 14 of the Litz-wire cable 12 before the ends 16A of the strands 16 are splayed and stripped of insulation. Then after the wire ends are soldered to the transition component 20, the collar 28 is slidably moved forward toward the transition component 20. The outer surface 22C of the transition component body 22 and the forward or left end portion 34 of the collar housing 30 have complementary interengagable external and internal threaded portions 58, 60 for attaching them together. Once they are threadably fastened together, a clamp (not shown) can be applied about the rear or right end portion 32 of the housing 30 for clamping it about the outer jacket 14 of the cable 12.

It will be readily understood that the collar 28 protects the splayed wire bundle and provides a secondary seal because it fits snugly over the conductor insulation. However, the seal made permanent by first sliding a fiberglass sleeving (not shown) from the cable (or wrapping an insulating fiber around the cable) over the collar, then potting the sleeving and collar with high-temperature epoxy. One type of epoxy chosen for the electromagnetic flow control device application cures at about 140 degrees C., so the entire connector assembly would be exposed to this temperature during the curing process.

Impedance measurements were made using a setup which simulates or models the use of the connector assembly 10. Two connectors, each composed of the electrically-connected transition and terminal components of the connector assembly, were connected on opposite sides of a short copper tube of the same diameter. The connectors were pressed into either end of the copper tube and fillet soldered around the conical contact. This ensured an accurate modelling of current transfer between the Litz-wire conductor cable and the connectors.

Figure 16:
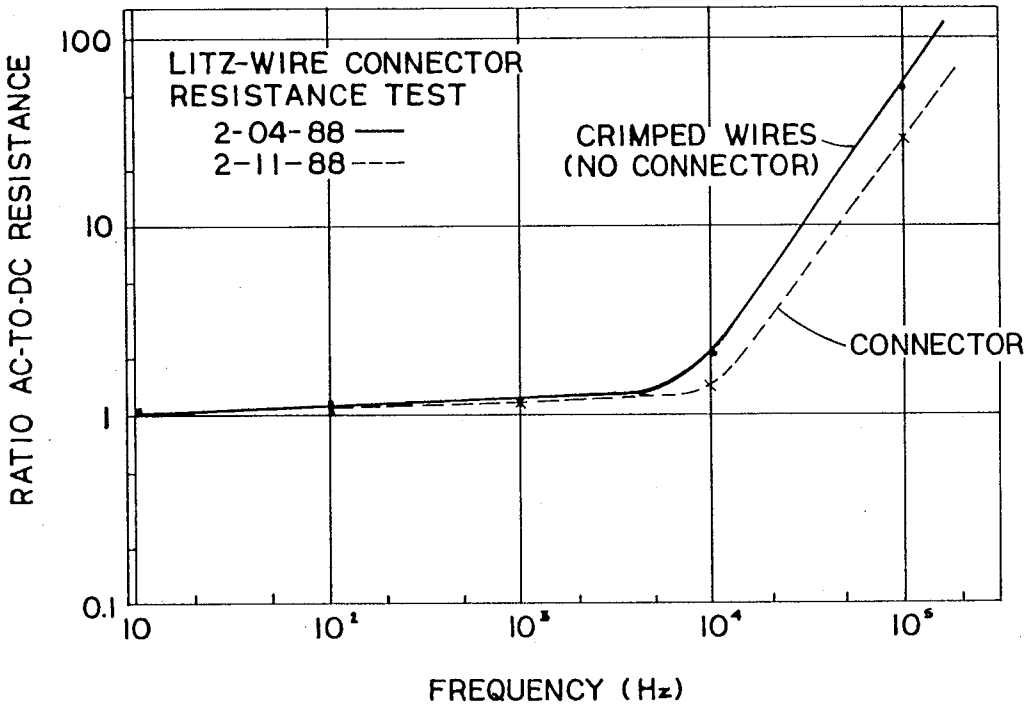
FIG. 16 is a graph of electrical resistance versus frequency for current transfer through the connector assembly of the present invention compared to current transfer through crimped wires.

Direct current (dc) resistance and alternating current (ac) impedance measurements (resistance and inductance) were performed using a micro-ohmmeter and LCR bridge, respectively. FIG. 16 is a graph of electrical resistance versus frequency for current transfer through the connectors compared to current transfer through crimped wires. Results showed good performance (i.e., nearly equivalent dc and ac resistance) up to roughly 10 kHz, which is evidence of significant reduction in the skin effect.

In conclusion, the connector assembly 10 disclosed herein provides a satisfactory method of transferring current to, from or between separate sections of, Litz-wire conductor cable with internal air cooling. Electrical impedance measurements indicate little skin effect occurring at typical operating frequencies for a flow control device, namely 10 kHz. In order to overcome the skin depth problem at the high frequency, the connector assembly 10 of the present invention implements two factors in its design: (1) the current transfer takes place through an annular region approximately one skin depth thick; and (2) the connector material chosen (being brass) is one which has a relatively large skin depth in relation to the material (being copper) of the conductors 16 of the cable 12.

It is thought that the connector assembly of the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

We claim:

1. A connector assembly for transferring high-frequency current into or from an electrical cable having multiple conductor strands, said connector assembly comprising:

(a) a connector body;

(b) means on said body for receiving and making electrical connection with ends of the multiple conductor strands to be disposed in an annular splayed configuration of a diameter larger than the diameter of the cable to be connected; and (c) means on said body for making an external electrical connection;

(d) said body having opposite axial ends and said receiving means being an annular groove formed in one end of said body for receiving the conductor strand ends to be received in the annular splayed configuration and a bonding material for electrically connecting the ends to the body at said groove.

2. The connector assembly as recited in claim 1, wherein said annular groove is defined by an outer cylindrical surface and an inner frustoconical tapered surface which intersects said cylindrical surface.

3. The connector assembly as recited in claim 1, wherein said external electrical connection making means is a tab attached to and projecting from the opposite end of said body.

4. A connector assembly for transferring high-frequency current into or from an electrical cable having multiple conductor strands and an internal coolant flow channel through said cable, said connector assembly comprising:

(a) a connector body;

(b) means on said body for receiving and making electrical connection with ends of the multiple conductor strands to be disposed in an annular splayed configuration of a diameter larger than the diameter of the cable to be connected;

(c) means defining a passage through said body for providing flow communication between an external source of coolant and the internal coolant flow channel of the electrical cable; and (d) means on said body for making an external electrical connection;

(e) said body having opposite axial ends and said receiving means being an annular groove formed in one end of said body for receiving the conductor strand ends to be received in the annular splayed configuration and a bonding material for electrically connecting the ends to the body at said groove.

5. The connector assembly as recited in claim 7, wherein said annular groove is defined by an outer cylindrical surface and an inner frustoconical tapered surface extending into said body from said one end thereof, said tapered surface intersecting with said cylindrical surface.

6. The connector assembly as recited in claim 7, wherein said external electrical connection making means is a tab attached to and projecting from the opposite end of said body.

7. A connector assembly for transferring high-frequency current into or from a Litz-wire electrical cable having multiple conductor strands and an internal coolant flow channel through said cable, said connector assembly comprising:

(a) a transition connector component having a body with opposite ends, means on one of said ends of said transition component body for receiving and making electrical connection with ends of the multiple conductor strands disposed in an annular splayed configuration, and means defining an opening through said transition component body for providing flow communication with the internal coolant flow channel of the electrical cable;

(b) a terminal connector component having a body, means defining an orifice through said terminal component body for establishing flow communication between said opening of said transition component body and an external source of coolant, and means on said terminal component body for making an external electrical connection;

(c) first complementary means on said respective transition and terminal component bodies for electrically connecting said bodies together;

(d) a coupling collar having a housing of frusto-conical configuration for fitting over end portions of the conductor strands of the cable to be connected which have the ends in the annular splayed configuration, and means on said housing for attaching said collar to the Litz-wire cable to be connected; and (e) second complementary means on said respective collar housing and said transition component body for attaching said housing thereto.

8. The connector assembly as recited in claim 7, wherein said receiving means of said transition connector component is an annular groove formed in said one of said ends of the transition component body for receiving the conductor strand ends to be received in the annular splayed configuration and a bonding material for electrically connecting the ends to the transition component body at said groove.

9. The connector assembly as recited in claim 14, wherein said annular groove is defined by an outer cylindrical surface and an inner frustoconical tapered surface extending into said transition component from said one end thereof, said tapered surface intersecting with said cylindrical surface.

10. The connector assembly as recited in claim 13, wherein said external electrical connection making means is a tab attached to and projecting from the terminal component.

11. The connector assembly as recited in claim 13, wherein said first complementary means on said bodies of said transition and terminal components include complementary flat end surfaces and alignable holes formed therein for receiving fasteners to electrically connect said components together.

12. The connector assembly as recited in claim 11, wherein said holes in said flat end surface of said transition component are greater in number than said holes in said flat end surface of said terminal component.

13. The connector assembly as recited in claim 13, wherein said second complementary means on said transition component and said collar housing are interengagable threaded portions for attaching said transition component and collar together.

14. The connector assembly as recited in claim 13, wherein said orifice defined through said terminal component body extends in orthogonal relation to said opening defined through said transition component body and has an internally threaded end portion for threadably receiving a fitting of the external source of coolant.

15. A connector assembly for transferring high-frequency current into or from an electrical cable having multiple conductor strands, said connector assembly comprising:

(a) a connector body;

(b) means on said body for receiving and making electrical connection with ends of the multiple conductor strands to be disposed in an annular splayed configuration of a diameter larger than the diameter of the cable to be connected; and (c) means on said body for making an external electrical connection;

(d) a coupling collar for fitting over end portions of the conductor strands of the cable to be connected having the ends in the annular splayed configuration, said collar having a main housing and an end portion with means for attaching to the cable to be connected, said main housing having a frusto-conical configuration; and (e) complementary means on said collar and connector body for attaching them together.

16. A connector assembly for transferring high-frequency current into or from an electrical cable having multiple conductor strands and an internal coolant flow channel through said cable, said connector assembly comprising:

(a) a connector body;

(b) means on said body for receiving and making electrical connection with ends of the multiple conductor strands to be disposed in an annular splayed configuration of a diameter larger than the diameter of the cable to be connected;

(c) means defining a passage through said body for providing flow communication between an external source of coolant and the internal coolant flow channel of the electrical cable;

(d) means on said body for making an external electrical connection;

(e) a coupling collar for fitting over end portions of the conductor strands of the cable having the ends in the annular splayed configuration, said collar having a main housing and an end portion with means for attaching to the cable, said main housing having a frusto-conical configuration; and (f) complementary means on said collar and connector body for attaching them together.

* * * * *